US006187174B1

(12) United States Patent
Morel et al.

(10) Patent No.: US 6,187,174 B1
(45) Date of Patent: Feb. 13, 2001

(54) PROCESS FOR CONVERTING HEAVY PETROLEUM FRACTIONS IN AN EBULLATED BED, WITH ADDITION OF A PRE-CONDITIONED CATALYST

(75) Inventors: Frédéric Morel, Francheville; Stéphane Kressmann, Serezin du Rhone; Virginie Harle; Slavik Kasztelan, both of Rueil Malmaison, all of (FR)

(73) Assignee: Institut Francais du Petrole, Rueil Malmaison Cedex (FR)

( * ) Notice: Under 35 U.S.C. 154(b), the term of this patent shall be extended for 0 days.

(21) Appl. No.: 09/233,206

(22) Filed: Jan. 19, 1999

(30) Foreign Application Priority Data

Jan. 16, 1998 (FR) ..... 98 00530

(51) Int. Cl.[7] ..... C10G 45/04; C10G 45/60

(52) U.S. Cl. ..... 208/213; 208/108; 208/146; 208/152; 208/153; 208/157; 208/251 H

(58) Field of Search ..... 208/108, 146, 208/152, 153, 157, 213, 251 H, 215

(56) References Cited

U.S. PATENT DOCUMENTS

| | | | | |
|---|---|---|---|---|
| 3,686,093 | | 8/1972 | Irvine | 208/57 |
| 3,893,911 | | 7/1975 | Rovesti et al. | 208/251 |
| 4,485,183 | * | 11/1984 | Miller et al. | 502/25 |
| 4,549,957 | * | 10/1985 | Hensley, Jr. et al. | 208/216 PP |
| 4,581,129 | * | 4/1986 | Miller et al. | 208/216 R |
| 4,636,487 | * | 1/1987 | Parrott et al. | 502/168 |
| 4,715,948 | * | 12/1987 | Sughrue, II et al. | 208/251 H |
| 4,728,417 | * | 3/1988 | Aldag, Jr. et al. | 208/216 R |
| 4,775,652 | * | 10/1988 | Aldag, Jr. et al. | 502/162 |
| 5,024,751 | | 6/1991 | Giuliani et al. | 208/108 |
| 5,039,392 | | 8/1991 | Bearden, Jr. et al. | 208/112 |
| 5,334,307 | * | 8/1994 | Simpson et al. | 208/254 H |
| 5,384,297 | * | 1/1995 | Prada et al. | 502/66 |
| 5,444,033 | * | 8/1995 | Usui et al. | 502/314 |
| 5,980,730 | * | 11/1999 | Morel et al. | 208/96 |

* cited by examiner

*Primary Examiner*—Benjamin L. Utech
*Assistant Examiner*—Nadine Preisch
(74) *Attorney, Agent, or Firm*—Millen, White, Zelano & Branigan, P.C.

(57) ABSTRACT

A process for converting a heavy hydrocarbon fraction comprises a step a) for treating a hydrocarbon feed in a hydroconversion section in the presence of hydrogen, the section comprising at least one three-phase reactor containing at least one ebullated bed of hydroconversion catalyst operating in riser mode for liquid and for gas, said reactor comprising at least one means for extracting used catalyst from said reactor and at least one means for adding fresh catalyst to said reactor, b) a step for treating fresh catalyst and conditioning the catalyst using a process leading to a gain in the activity of the catalyst during treatment of the feed in said conversion reactor. This process for conditioning the catalyst before adding it to the reactor can comprise a step for impregnating the catalyst with a chemical substance, or a complete sulphurisation step, or a step for adding an additive mixed with the fresh catalyst which is added.

13 Claims, No Drawings

PROCESS FOR CONVERTING HEAVY PETROLEUM FRACTIONS IN AN EBULLATED BED, WITH ADDITION OF A PRE-CONDITIONED CATALYST

BACKGROUND OF THE INVENTION

The present invention relates to refining and converting heavy hydrocarbon fractions containing, inter alia, asphaltenes and sulphur-containing and metallic impurities. More particularly, it relates to a process for improving the activity of continuously added fresh catalyst in an ebullated bed hydroconversion process with an apparatus for in-line addition of fresh catalyst and extraction of used catalyst, for example the H-Oil process described in United States patents U.S. Pat. No. 4,521,295 or U.S. Pat. No. 4,495,060 or U.S. Pat. No. 4,457,831 or U.S. Pat. No. 4,354,852 or in the NPRA article, March 16–18, San Antonio, Tex., paper number AM 97-16.

SUMMARY OF THE INVENTION

The present invention relates to a method of conditioning and treating a catalyst before introducing it into a high temperature, high pressure reactor.

The process can be defined as a process for converting a heavy hydrocarbon fraction with a Conradson carbon of at least 10% by weight, and a metal content of at least 50 ppm, normally at least 100 ppm and usually at least 200 ppm by weight. The feeds which can be treated comprise at least 0.5% by weight of sulphur, normally more than 1% by weight of sulphur, frequently more than 2% by weight of sulphur and usually up to 4% or even up to 10% by weight of sulphur, and at least 1% by weight of $C_7$ asphaltenes. The asphaltenes content (resulting, for example, from solvent extraction of $C_7$) in feeds treated in the context of the present invention is normally over 2%, usually over 5% by weight, and can equal or even exceed 24% by weight.

The hydrocarbon feed is treat ed in a hydroconversion section in the presence of hydrogen, the section comprising at least one three-phase reactor containing at least one ebullated bed of hydroconversion catalyst, operating in riser mode for liquid and for gas, said reactor comprising at least one means for extracting catalyst from said reactor and at least one means for adding fresh catalyst to said reactor, under conditions which produce a liquid effluent with a reduced Conradson number, and reduced metals and sulphur contents.

The conditions for treating the feed in the presence of hydrogen are normally as follows. At least one conventional granular hydroconversion catalyst is used in the hydroconversion zone. That catalyst can be a catalyst comprising group VIII metals, for example nickel and/or cobalt, usually in combination with at least one group VIB metal, for example molybdenum. A catalyst comprising 0.5% to 10% by weight of nickel or cobalt, preferably 1% to 5% by weight of nickel or cobalt (expressed as the nickel or cobalt oxide) and 1% to 30% by weight of molybdenum, preferably 5% to 20% by weight of molybdenum (expressed as molybdenum oxide $MoO_3$) can be used on a support, for example a support containing a mineral oxide, preferably selected from the group formed by alumina and silica. The catalyst is usually in the form of extrudates or beads.

The absolute pressure is normally 5 to 35 MPa, usually 10 to 25 MPa, and the temperature is about 300° C. to about 500° C., normally about 350° C. to about 450° C. The hourly space velocity (HSV) of the liquid and the partial pressure of hydrogen are important factors which are selected as a function of the characteristics of the feed to be treated and the desired conversion. The HSV of the liquid is usually about 0.1 to about 5 $h^{-1}$, preferably about 0.15 to about 2 $h^{-1}$, and the quantity of hydrogen mixed with the feed is about 50 to 5000 $Nm^3/m^3$.

Used catalyst is partially replaced by fresh catalyst by gradually (periodically or continuously) extracting used catalyst from the bottom of the reactor and gradually (periodically or continuously) adding fresh or new catalyst to the top of the reactor, for example at regular time intervals, for example daily. The rate of replacing used catalyst with fresh catalyst can, for example, be about 0.05 kilograms to about 10 kilograms per cubic meter of feed. Such gradual extraction and replacement are carried out using apparatus enabling this hydroconversion step to be operated continuously. The reactor normally includes a re-circulation pump which maintains the catalyst in an ebullated bed by continuously recycling at least a portion of the liquid extracted from the head of the reactor and re-injecting it at the bottom of the reactor.

At least one catalyst can be used, ensuring both demetallisation and desulphurisation, under conditions which produce a liquid feed with a reduced metal content, reduced Conradson carbon and reduced sulphur content and which can produce a high rate of conversion of light products, i.e., in particular of gasoline fuel and gas oil fractions.

In its most general form, the present invention provides a process for converting a heavy hydrocarbon fraction comprising a section for hydroconversion carried out in the presence of hydrogen, the section comprising at least one three-phase reactor containing at least one ebullated bed of hydroconversion catalyst operating in riser mode for liquid and for gas, said reactor comprising at least one means for extracting used catalyst from said reactor and at least one means for adding fresh catalyst to said reactor, under conditions which produce a liquid feed with a reduced Conradson carbon, a reduced metal content, and a reduced sulphur content, characterized in that the catalyst or catalysts are pre-conditioned before being injected into the reactor or reactors, said pre-conditioning producing a catalyst which is at least partially sulphurised.

The heavy hydrocarbon fraction which is treated in the present invention is normally an atmospheric residue or a vacuum residue or a mixture of the two residues with a Conradson carbon of at least 10% by weight, a metal content of at least 50 ppm by weight, an asphaltene content of at least 1% by weight and a sulphur content of at least 0.5% by weight. This heavy hydrocarbon fraction can also be a vacuum distillate or a deasphalted oil with an initial boiling point of at least 300° C. and a sulphur content of at least 0.5% by weight, or a heavy coking distillate, or a heavy fluidised bed catalytic cracking distillate, or an aromatic extract, or a mixture of at least two of these products.

More particularly, the present invention concerns pretreatment of fresh catalyst added to the ebullated bed reactor, in accordance with the steps described below.

The catalyst is transported from its storage point to a receptacle for nitrogen inerting. The catalyst is weighed then transferred under gravity to a further receptacle where the conditioning operations are carried out. This latter receptacle is pressurised under hydrogen and a petroleum cut which may have been heated can be injected, for example a heavy vacuum distillate (VGO).

Firstly, then, the catalyst is wetted using this petroleum cut, for example a VGO, at a temperature of 320° C., for example.

The receptacle is then pressurised under hydrogen to the pressure of the reactor, for example 20 MPa. The petroleum cut is then circulated and its temperature is adjusted to the operating conditions for forming the catalyst. In a conventional unit, the catalyst is injected in this form. The present invention consists of pre-conditioning the catalyst before introducing the catalyst into the reactor. This pre-conditioning can be offsite deposition of sulphur-containing compounds onto the catalyst followed by sulphurisation proper (passage from the oxide to the sulphide) near the hydroconversion reactor, or complete offsite sulphurisation of the catalyst (passage from the oxide state to the sulphide state).

A description of a number of pre-conditioning types will now be given:

a) The fresh catalyst can be mixed in a receptacle near the hydroconversion reactor (i.e., offsite, or ex situ) with a petroleum cut, for example a vacuum distillate (VGO) and with a sulphur-containing compound, said sulphur-containing compound normally being a sulphurisation additive with a high sulphur content which can, for example, be dimethyldisulphide (DMDS: 66% sulphur) or a polysulphide type compound (for example di-tertio-nonylpolysulphide, known under the trade references TPS37 or TPS54: 37% and 54% of sulphur respectively). The receptacle is then pressurised to the pressure of the hydroconversion reactor (for example 20 MPa) and heated to a temperature which can, for example, be 350° C. for a period which can, for example, be 12 hours. Sulphurisation proper of the active phase of the catalyst (passage from the oxide to the sulphide) is then carried out in said receptacle by reacting the sulphur-containing, compounds with hydrogen. The conditioned catalyst is then added to the hydroconversion reactor.

b) The catalyst can contain one or more sulphurising agents (sulphur-containing compounds, normally with a high sulphur content), pre-deposited offsite (ex situ) on fresh catalyst using, for example, the SULFICAT process as described, for example in European patents EP-B-0 130 850 or EP-B-0 181 254. The pre-conditioned catalyst is mixed with an atmospheric distillate or vacuum distillate (VGO) type petroleum cut in a receptacle near the hydroconversion reactor. The receptacle is then pressurised to the hydroconversion reactor pressure (for example 20 MPa) and heated to a temperature which can, for example, be 350° C. for a period of 12 hours, for example. Sulphurisation proper of the active phase of the catalyst (passage from the oxide to the sulphide) is then carried out in said receptacle by reacting the sulphur-containing compounds with hydrogen. The catalyst is then added to the hydroconversion reactor.

c) The catalyst can be conditioned offsite (ex situ) using the TOTSUCAT process described, for example in EP-A-0 707 890. That process results in complete sulphurisation of the active phase of the catalyst (the metals are in the form of sulphides). The pre-conditioned catalyst is mixed with an atmospheric distillate or vacuum distillate (VGO) type petroleum cut in a receptacle near the hydroconversion reactor. The receptacle is then pressurised to the hydroconversion reactor pressure (for example 20 MPa) and heated to a temperature which can, for example, be 320° C. The catalyst is then added to the hydroconversion reactor.

Usually, the temperature of the receptacle in which the catalyst is placed before its injection into the hydroconversion reactor is in the range 150° C. to 450° C. and its pressure is usually about 5 to 35 MPa.

In the process of the present invention, at least a portion of the hydroconverted liquid effluent can be sent to an atmospheric distillation zone from which a distillate and an atmospheric residue are recovered. Subsequently, at least a portion of the atmospheric residue obtained can be sent to a vacuum distillation zone from which a distillate and a vacuum residue are recovered.

In a further variation of the process of the invention, at least a portion of the heaviest liquid fraction of the hydrotreated feed obtained is sent to a storage zone for heavy fuel oil with a very low sulphur content. It is still possible to split the distillates obtained from the hydroconversion step into a gasoline fraction and a gas oil fraction which are sent at least in part to their respective fuel storage zones. The following examples illustrate the invention without in any way limiting its scope.

EXAMPLE 1

Comparative

A pilot hydrotreatment unit comprising 2 reactors in series was used. In each reactor, the catalyst was entrained in an ebullated bed using a pump for re-circulating the liquid effluent from the reactor. Each reactor had a volume of 3 liters. This pilot unit simulated the industrial H-Oil residue hydroconversion process and resulted in performances which were identical to those of industrial units.

A Safaniya vacuum residue was treated in this pilot unit: its characteristics are shown in Table 1. The catalyst used was that specifically for ebullated bed hydroconversion of residues described in Example 2 of U.S. Pat. No. 4,652,545 under reference numeral HDS-1443B. The operating conditions were as follows:

| | |
|---|---|
| HSV | = 0.5 with respect to the catalyst bed |
| P | = 15 MPa |
| T | = 420° C. |
| Hydrogen recycle | = 500 litres $H_2$/litres of feed |

The unit included an apparatus for adding fresh catalyst and extracting used catalyst. The rate of catalyst replacement was 1 kg/m$^3$ of feed.

During each catalyst extraction-addition sequence, carried out daily, the fresh catalyst underwent no particular pre-treatment before its incorporation into the reactor. Before adding, the catalyst was re-heated to a temperature of 80° C. in an inert atmosphere by a vacuum distillate, the temperature was increased to 250° C., the receptacle was then pressurised by hydrogen to the pressure of the unit. Communication valves between the receptacle and reactor were open, the capacity was thus flu shed with vacuum distillate, the temperature of which was 350° C., using a pump.

Table 2 shows the performances of the unit after one month of operation under the same operating conditions.

TABLE 1

| Analysis of feed: RSV Safaniya | |
|---|---|
| Density 15/4 | 1.046 |
| Sulphur (wt %) | 5.4 |
| Conradson carbon | 24.0 |
| C7 asphaltenes (weight %) | 14.5 |
| Nickel + vanadium (ppm) | 213 |
| Viscosity at 100° C. (cSt) | 5110 |

TABLE 2

| Overall process performances | |
|---|---|
| Density of C5+ liquid effluent | 0.929 |
| Hydrodesulphurisation (weight %) | 78.8 |
| Hydrodemetallisation (weight %) | 87.0 |
| Reduction in Conradson carbon (wt %) | 60.9 |
| Conversion of $565^{+\circ}$ C. (weight %) | 66.1 |

EXAMPLE 2

In Accordance with the Invention

The ebullated bed hydrotreatment pilot unit of Example 1 was used under the same operating conditions and with the same feed.

During each catalyst extraction-addition sequence, namely daily, the same catalyst as used in the preceding example was used, but this time the catalyst had first undergone prior sulphurisation using the TOTSUCAT complete offsite pre-sulphurisation process. The pre-sulphurised catalyst was re-heated to a temperature of 80° C. in an inert atmosphere using a vacuum distillate, its temperature was increased to 250° C., and the receptacle was then pressurised up to the pressure of the hydroconversion unit using hydrogen. The communicating valves between the receptacle and reactor were opened, the capacity was then flushed with vacuum distillate the temperature of which was 350° C., using a pump. The rate of catalyst replacement was a constant 1 kg/$m^3$ of feed.

Table 3 below shows the performances of the unit after 1 month's operation under the same operating conditions.

Compared with the preceding example, the only operating difference was pre-conditioning the catalyst by offsite pre-sulphurisation using the TOTSUCAT process.

It can be seen that this procedure very substantially improved the performances of the process, Hydrodesulphurisation, hydrodemetallation, Conradson carbon reduction and conversion of 565+° C. were improved over Example 1 in which the catalyst had been injected into the unit with no particular pre-treatment.

TABLE 3

| Overall process performances | |
|---|---|
| Density of C5+ liquid effluent | 0.909 |
| Hydrodesulphurisation (weight %) | 82.9 |
| Hydrodemetallisation (weight %) | 90.3 |
| Reduction in Conradson carbon (wt %) | 67.4 |
| Conversion of $565^{+\circ}$ C. (weight %) | 76.5 |

What is claimed is:

1. In a process for converting a heavy hydrocarbon fraction comprising conducting hydroconversion in a section for hydroconversion in the presence of hydrogen, the section comprising at least one three-phase reactor containing at least one ebullated bed of hydroconversion catalyst operating in riser mode for liquid and for gas, said reactor comprising at least one means for extracting used catalyst from said reactor and at least one means for adding fresh catalyst to said reactor, under conditions which produce a liquid feed with a reduced Conradson carbon, a reduced metal content, and a reduced sulphur content, the improvement wherein fresh catalyst is pre-conditioned before being injected into the reactor or reactors, said pre-conditioning producing a catalyst which is at least partially sulphurised, said fresh catalyst having an active phase comprising group VIII metals combined with group VIB metals on a support consisting essentially of a mineral oxide selected from the group consisting of alumina and silica.

2. A process according to claim 1, in which the preconditioning comprises bringing fresh catalyst into contact with a vacuum distillate (VGO) petroleum cut and with a sulphur-containing compound, said contact being carried out under hydrogen, in a receptacle near the hydroconversion reactor, and at a temperature which is sufficient to sulphurise at least a portion of the active phase of said catalyst before its introduction into the hydroconversion reactor.

3. A process according to claim 1, in which preconditioning of the catalyst before addition to said reactor comprises an offsite step for impregnating the catalyst with one or more sulphur-containing chemical substances, and in which sulphurisation proper of the active phase of the catalyst is carried out in a receptacle near the hydroconversion reactor, by reacting said sulphur-containing chemical substances with hydrogen under the temperature and pressure conditions in said receptacle, before introducing the catalyst into the hydroconversion reactor.

4. A process according to claim 1, in which the catalyst pre-conditioning is carried out offsite and comprises complete pre-sulphurisation of the active phase of the catalyst, before its introduction into the hydroconversion reactor in a sulphurised form.

5. A process according to claim 1, in which hydroconversion is carried out at an absolute pressure of 5 to 35 MPa, at a temperature of about 300° C. to 500° C. and with an hourly space velocity of about 0.1 to 5 $h^{-1}$, and the quantity of hydrogen mixed with the feed is about 50 to 5000 $Nm^3/m^3$.

6. A process according to claim 1, characterized in that the heavy hydrocarbon fraction is an atmospheric residue or a vacuum residue or a mixture of the two residues with a Conradson carbon of at least 10% by weight, a metal content of at least 50 ppm by weight, an asphaltene content of at least 1% by weight and a sulphur content of at least 0.5% by weight.

7. A process according to claim 1, characterized in that the heavy hydrocarbon fraction is a vacuum distillate or a deasphalted oil with an initial boiling point of at least 300° C. and a sulphur content of at least 0.5% by weight or a heavy coking distillate or a heavy fluidised bed catalytic cracking distillate or an aromatic extract or a mixture of at least two of those products.

8. A process according to claim 1, in which at least a portion of resultant hydroconverted liquid effluent is sent to an atmospheric distillation zone from which a distillate and an atmospheric residue are recovered.

9. A process according to claim 8, in which at least a portion of the atmospheric residue obtained is sent to a vacuum distillation zone from which a vacuum distillate and a vacuum residue are recovered.

10. A process according to claim 9, in which at least a portion of the vacuum residue liquid fraction of the hydrotreated feed is sent to a zone for storing heavy fuel oil with a very low sulphur content.

11. A process according to claim 1, in which effluents obtained from the hydroconversion step are fractionated into a gasoline fraction and a gas oil fraction which are sent at least in part to their respective fuel storage.

12.A process according to claim 1, the catalyst is placed in a receptacle before injecting it into the hydroconversion reaction, said receptacle having a temperature in the range 150° C. to 450° C.

13. A process according to claim 1, in which the catalyst is placed in a receptacle before injecting it into the hydroconversion reactor, said receptacle having a pressure of about 5 to 35 MPa.

* * * * *

UNITED STATES PATENT AND TRADEMARK OFFICE

CERTIFICATE OF CORRECTION

PATENT NO. : 6,187,174 B1
DATED : February 13, 2001
INVENTOR(S) : Morel et al.

It is certified that error appears in the above-identified patent and that said Letters Patent is hereby corrected as shown below:

Column 8,
Line 6, after "storage" insert -- zones --.

Signed and Sealed this

Fifth Day of August, 2003

JAMES E. ROGAN
*Director of the United States Patent and Trademark Office*